US009860629B2

(12) United States Patent
Timothy et al.

(10) Patent No.: US 9,860,629 B2
(45) Date of Patent: Jan. 2, 2018

(54) SPEAKER ASSEMBLIES FOR PASSIVE GENERATION OF VIBRATIONS AND RELATED HEADPHONE DEVICES AND METHODS

(71) Applicant: Skullcandy, Inc., Park City, UT (US)

(72) Inventors: John Timothy, Salt Lake City, UT (US); Sam Noertker, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 14 days.

(21) Appl. No.: 14/982,786

(22) Filed: Dec. 29, 2015

(65) Prior Publication Data

US 2016/0192064 A1 Jun. 30, 2016

Related U.S. Application Data

(60) Provisional application No. 62/098,959, filed on Dec. 31, 2014.

(51) Int. Cl.
*H04R 3/00* (2006.01)
*H04R 1/28* (2006.01)
(Continued)

(52) U.S. Cl.
CPC ..... *H04R 1/2815* (2013.01); *H04R 1/1008* (2013.01); *H04R 1/1041* (2013.01);
(Continued)

(58) Field of Classification Search
CPC ..... H04R 1/2815; H04R 1/1066; H04R 2205/022; H04R 1/1008; H04R 1/1041;
(Continued)

(56) References Cited

U.S. PATENT DOCUMENTS 6,377,145 B1 4/2002 Kumagai
6,603,863 B1 8/2003 Nagayoshi
(Continued)

FOREIGN PATENT DOCUMENTS

CA 153644 A 2/1914
CA 2515558 A1 2/2007
(Continued)

OTHER PUBLICATIONS

Anonymous, Current Divider, https://en.wikipedia.org/wiki/Current_divider, Nov. 23, 2014, 5 pages.
(Continued)

*Primary Examiner* — Muhammad N Edun
(74) *Attorney, Agent, or Firm* — TraskBritt

(57) ABSTRACT

Speaker assemblies for a headphone device may include an audio speaker configured to produce audible sound in response to receiving an audio signal at the audio speaker. A tactile bass vibrator distinct from the audio speaker may be operatively connected to the audio speaker. The tactile bass vibrator may be configured to produce tactile vibrations in response to receiving the audio signal at the tactile bass vibrator. A current divider may be operatively connected to the audio speaker and the tactile bass vibrator, the current divider providing greater electrical resistance to flow of current to the audio speaker than to flow of current to the tactile bass vibrator.

17 Claims, 5 Drawing Sheets

(51) Int. Cl.
*H04R 1/10* (2006.01)
*H04R 5/033* (2006.01)

(52) U.S. Cl.
CPC ..... *H04R 1/1066* (2013.01); *H04R 3/00* (2013.01); *H04R 5/033* (2013.01); *H04R 2205/022* (2013.01); *H04R 2400/03* (2013.01); *H04R 2460/13* (2013.01)

(58) Field of Classification Search
CPC ..... H04R 2460/13; H04R 3/00; H04R 5/033; H04R 2400/03
See application file for complete search history.

(56) References Cited

U.S. PATENT DOCUMENTS

| | | | |
|---|---|---|---|
| 6,850,138 | B1 | 2/2005 | Sakai |
| 7,187,948 | B2 | 3/2007 | Alden |
| 7,395,090 | B2 | 7/2008 | Alden |
| D623,627 | S | 9/2010 | Alden et al. |
| D624,057 | S | 9/2010 | Kelly et al. |
| D641,003 | S | 7/2011 | Alden |
| 8,014,824 | B2 | 9/2011 | Alden |
| D650,356 | S | 12/2011 | Alden et al. |
| D656,129 | S | 3/2012 | Kelly et al. |
| D665,776 | S | 8/2012 | Alden et al. |
| D665,777 | S | 8/2012 | Alden et al. |
| D673,136 | S | 12/2012 | Kelly et al. |
| D673,140 | S | 12/2012 | Kelly et al. |
| D674,372 | S | 1/2013 | Kelly et al. |
| D674,376 | S | 1/2013 | Kelly et al. |
| D676,023 | S | 2/2013 | Kelly et al. |
| D676,024 | S | 2/2013 | Kelly et al. |
| D677,241 | S | 3/2013 | Kelly et al. |
| D683,717 | S | 6/2013 | Kelly et al. |
| 8,457,557 | B2 | 6/2013 | Alden |
| D685,759 | S | 7/2013 | Kelly et al. |
| D685,767 | S | 7/2013 | Kelly et al. |
| 8,515,115 | B2 | 8/2013 | Kelly et al. |
| D689,464 | S | 9/2013 | Bonahoom et al. |
| 8,542,859 | B2 | 9/2013 | Alden |
| D691,582 | S | 10/2013 | Nguyen et al. |
| D693,793 | S | 11/2013 | Kelly et al. |
| 8,594,362 | B2 | 11/2013 | Liu |
| D699,216 | S | 2/2014 | Bonahoom et al. |
| D701,193 | S | 3/2014 | Kelly et al. |
| D701,196 | S | 3/2014 | Kelly et al. |
| D701,197 | S | 3/2014 | Kelly et al. |
| D707,654 | S | 6/2014 | Nguyen et al. |
| 8,767,996 | B1 | 7/2014 | Lin et al. |
| 8,942,403 | B2 | 1/2015 | Oman et al. |
| 8,965,028 | B2 | 2/2015 | Oishi et al. |
| 2004/0064066 | A1 | 4/2004 | John et al. |
| 2006/0171553 | A1 | 8/2006 | Wong et al. |
| 2006/0262954 | A1 | 11/2006 | Lee et al. |
| 2007/0142025 | A1 | 6/2007 | Alden |
| 2008/0112581 | A1* | 5/2008 | Kim ..... H04R 1/1075 381/151 |
| 2008/0267440 | A1 | 10/2008 | Alden |
| 2010/0239115 | A1 | 9/2010 | Richardson |
| 2010/0260371 | A1 | 10/2010 | Afshar |
| 2011/0075880 | A1 | 3/2011 | Kamimura et al. |
| 2011/0164776 | A1 | 7/2011 | Kelly et al. |
| 2011/0235819 | A1 | 9/2011 | Alden |
| 2011/0317856 | A1 | 12/2011 | Akasu |
| 2012/0087519 | A1* | 4/2012 | Emilsson ..... G10K 11/1786 381/151 |
| 2012/0128172 | A1 | 5/2012 | Alden |
| 2012/0275615 | A1 | 11/2012 | Kelly et al. |
| 2013/0051585 | A1* | 2/2013 | Karkkainen ..... H04R 1/1075 381/151 |
| 2013/0118944 | A1 | 5/2013 | Niiro et al. |
| 2013/0130540 | A1 | 5/2013 | Oman et al. |
| 2013/0177165 | A1 | 7/2013 | Oishi |
| 2013/0177195 | A1 | 7/2013 | Sze et al. |
| 2013/0185905 | A1 | 7/2013 | Stiff et al. |
| 2013/0208909 | A1 | 8/2013 | Mulder |
| 2013/0225915 | A1 | 8/2013 | Redfield et al. |
| 2013/0336514 | A1 | 12/2013 | Kelly et al. |
| 2014/0056459 | A1 | 2/2014 | Oishi et al. |
| 2014/0056463 | A1 | 2/2014 | Kim et al. |
| 2014/0168349 | A1* | 6/2014 | Eom ..... G02B 27/01 348/14.03 |
| 2014/0270228 | A1 | 9/2014 | Oishi et al. |
| 2014/0270230 | A1 | 9/2014 | Oishi et al. |
| 2016/0123745 | A1 | 5/2016 | Cotier et al. |

FOREIGN PATENT DOCUMENTS

| | | | |
|---|---|---|---|
| CA | 2697029 | A1 | 2/2007 |
| EP | 1760896 | A1 | 3/2007 |
| EP | 1841278 | A1 | 10/2007 |
| EP | 2262117 | A1 | 12/2010 |
| EP | 2701400 | A2 | 2/2014 |
| WO | 2010068495 | A2 | 6/2010 |
| WO | 2010124190 | A2 | 10/2010 |
| WO | 2011085096 | A2 | 7/2011 |
| WO | 2012024656 | A2 | 2/2012 |

OTHER PUBLICATIONS

European Search Report for European Application No. 15202034.3 dated Feb. 24, 2016, 11 pages.

Harris, Wayne, How to—Car Stereo—Nine Ways to Adjust Signal Level, http://www.termpro.com/asp/pubs.asp?ID=119, Jul. 1, 1990, 9 pages.

Noertker et al., Methods of Generating Tactile User Feedback Utilizing Headphone Devices and Related Systems, U.S. Appl. No. 14/982,647, filed Dec. 29, 2015.

European Office Action for European Application No. 15202034 dated Sep. 7, 2017, 11 pages.

* cited by examiner

SPEAKER ASSEMBLIES FOR PASSIVE GENERATION OF VIBRATIONS AND RELATED HEADPHONE DEVICES AND METHODS

CROSS-REFERENCE TO RELATED APPLICATION

This application claims the benefit of U.S. Provisional Patent Application Ser. No. 62/098,959, filed Dec. 31, 2014. The subject matter of this application is related to the subject matter of U.S. Patent App. Pub. No. 2014/0056459, published Feb. 27, 2014, now U.S. Pat. No. 8,965,028, issued Feb. 24, 2015, and titled "SPEAKERS, HEADPHONES, AND KITS RELATED TO VIBRATIONS IN AN AUDIO SYSTEM, AND METHODS FOR FORMING SAME," the disclosure of each of which is incorporated in this application in its entirety by this reference.

FIELD

This disclosure relates generally to speaker assemblies for headphone devices, headphone devices including such speaker assemblies, and related methods. More specifically, disclosed embodiments relate to speaker assemblies for headphone devices including tactile bass vibrators configured to generate tactile vibrations that may be sensed by persons using the headphone devices, wherein the tactile bass vibrators may not be powered by a dedicated amplifier.

BACKGROUND

Conventional portable audio systems often include a headphone that is connected to a media player (e.g., by one or more wires or by wireless technology). Conventional headphones may include one or more speaker assemblies having an audio driver that produces audible sound waves with a diaphragm. Some speaker assemblies may further include another audio driver that produces audible sound waves and tactile vibrations. Such audio drivers may conventionally be powered by a dedicated amplifier to enable the audio drivers to produce the tactile vibrations. For example, headphone devices incorporating audio drivers that produce tactile vibrations and are powered by a dedicated amplifier are disclosed in U.S. Patent App. Pub. No. 2014/0056459, published Feb. 27, 2014, and titled "SPEAKERS, HEADPHONES, AND KITS RELATED TO VIBRATIONS IN AN AUDIO SYSTEM, AND METHODS FOR FORMING SAME," the disclosure of which was previously incorporated into this application in its entirety by reference. In addition, headphone devices incorporating such audio drivers are commercially available from Skullcandy, Inc., of Park City, Utah, under the trademark SKULLCRUSHERS®.

BRIEF SUMMARY

In some embodiments, the present disclosure includes a headphone device comprising a headband sized and shaped to rest on a user's head, and an ear cup at each of two ends of the headband. The ear cups are located proximate a user's ears when the user wears the headband. Each ear cup supports a speaker assembly within an internal cavity defined by a housing of each ear cup. Each of the speaker assemblies includes an audio speaker configured to produce audible sound in response to receiving an audio signal at the audio speaker, and a tactile bass vibrator distinct from the audio speaker. The tactile bass vibrator is configured to produce tactile vibrations in response to receiving the audio signal at the tactile bass vibrator. The tactile bass vibrator being is connected to the audio speaker. A current divider is operatively connected to the audio speaker and the tactile bass vibrator. The current divider provides greater electrical resistance to flow of current to the audio speaker than to flow of current to the tactile bass vibrator.

In additional embodiments, the present disclosure includes a headphone device including a headband sized and shaped to rest on a user's head, and an ear cup attached to the headband at each of two ends of the headband utilizing a headband attachment structure of the ear cup. The ear cups are located proximate a user's ears when the user wears the headband. Each ear cup supports a speaker assembly within an internal cavity defined by a housing of each ear cup. Each speaker assembly includes an audio speaker configured to produce audible sound in response to receiving an audio signal at the audio speaker, and a tactile bass vibrator distinct from the audio speaker. The tactile bass vibrator includes a vibration member configured to produce tactile vibrations in response to receiving the audio signal at the tactile bass vibrator. The tactile bass vibrator is operatively connected to the audio speaker. A circumference of the vibration member of the tactile bass vibrator intersects with a circumference of the headband attachment structure of the ear cup, and the headband attachment structure extends into a cutaway void defined by the vibration member.

In yet additional embodiments, the present disclosure includes a method of forming a speaker assembly for a headphone device. In accordance with such a method, an audio speaker is configured to produce audible sound in response to receiving an audio signal at the audio speaker. A tactile bass vibrator distinct from the audio speaker is operatively connected to the audio speaker. The tactile bass vibrator is configured to produce tactile vibrations in response to receiving the audio signal at the tactile bass vibrator. A current divider is operatively connected to the audio speaker and the tactile bass vibrator. The current divider provides greater electrical resistance to flow of current to the audio speaker than to flow of current to the tactile bass vibrator.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular apparatus or component thereof, but are merely idealized representations employed to describe illustrative embodiments. Thus, the drawings are not necessarily to scale.

Disclosed embodiments relate generally to speaker assemblies for headphone devices including tactile bass vibrators configured to generate tactile vibrations that may be sensed by persons using the headphone devices, wherein the tactile bass vibrators may not be powered by a dedicated amplifier. More specifically, disclosed are embodiments of speaker assemblies including an audio speaker configured to produce audible sound and a distinct tactile bass vibrator configured to produce tactile vibration, which may include a current divider to control flow of electrical power to the audio speaker and the tactile bass vibrator.

A "speaker" is defined herein as an acoustic device configured to contribute to the generation of sound waves, such as with the reproduction of speech, music, or other audible sound. A speaker may also produce tactile vibrations that may be felt by a person. Thus, a speaker may include a tactile bass vibrator. A tactile bass vibrator may also be referred to as a transducer, a driver, a shaker, etc.

A "bass frequency" is a relatively low audible frequency generally considered to be within the range extending from approximately 16 Hz to approximately 512 Hz. For purposes of this disclosure, a "low bass frequency" refers to bass frequencies that may be felt as well as heard. Such low bass frequencies may be within the range extending from approximately 16 Hz to approximately 200 Hz.

Figure 1:
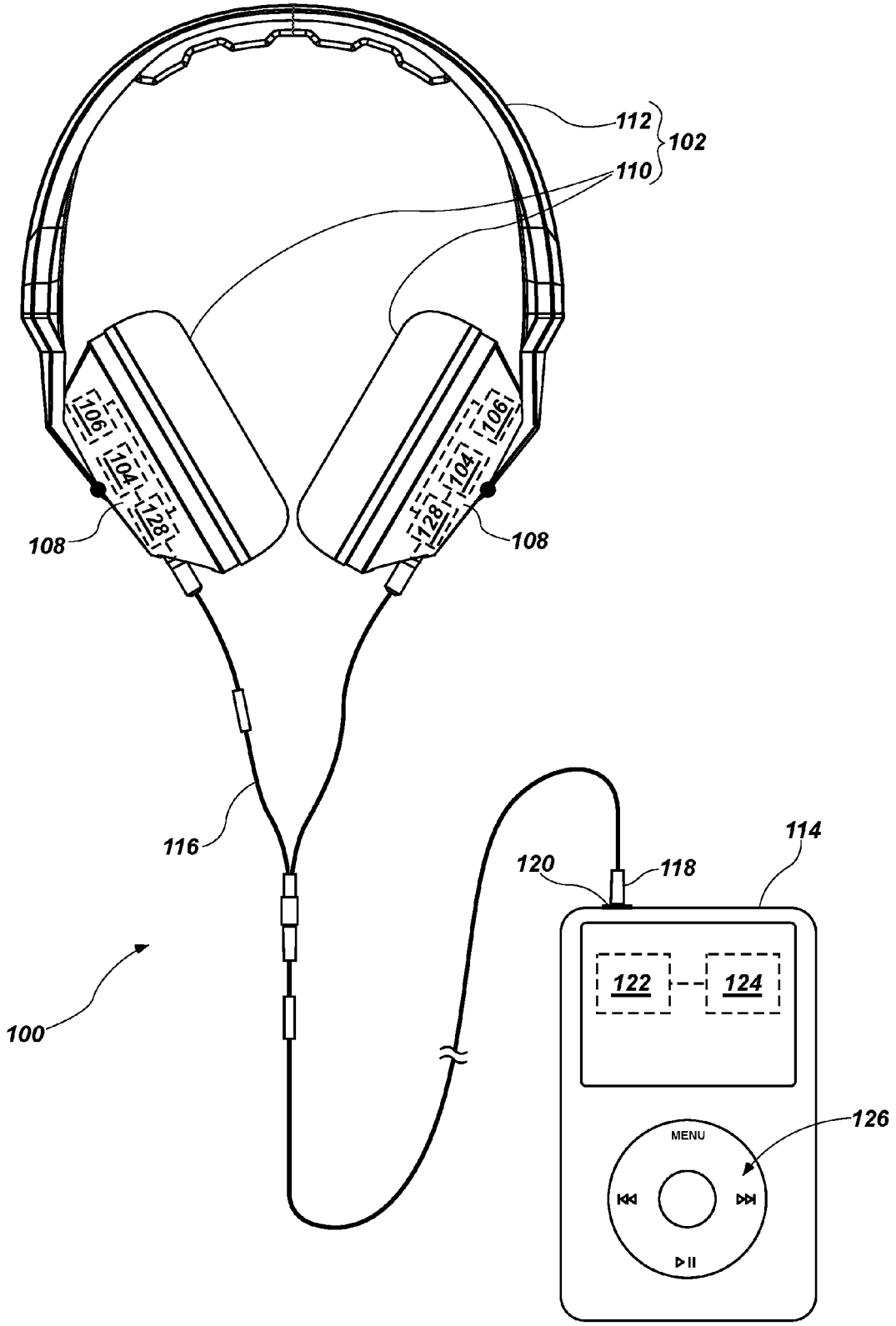
FIG. 1 is a simplified view of an audio system including a headphone device configured to passively generate vibrations.

Referring to FIG. 1, a simplified view of an audio system 100 including a headphone device 102 configured to passively generate vibrations is shown. The headphone device 102 may include one or more audio speakers 104 and one or more tactile bass vibrators 106. For example, the headphone device 102 may include left-side and right-side audio speakers 104 and left-side and right-side tactile bass vibrators 106. The audio speakers 104 may be distinct from the tactile bass vibrators 106.

The audio speakers 104 may be configured to generate, for example, audible sound in response to receiving an audio signal at the audio speakers 104. More specifically, the audio speakers 104 may be configured to generate, for example, audible sound in at least high and midlevel audible frequencies in response to receiving an audio signal at the audio speakers 104. As a specific, nonlimiting example, a resonant frequency of the audio speakers 104 may be between about 512 Hz and about 16 kHz. The tactile bass vibrators 106 may be configured to generate, for example, tactile vibrations in response to receiving the audio signal at the tactile bass vibrator 106. More specifically, the tactile bass vibrators 106 may be configured to generate, for example, tactile vibrations (e.g., at least at bass frequencies or low bass frequencies) and audible sound in response to receiving the audio signal at the tactile bass vibrator 106. As specific, nonlimiting examples, a resonant frequency of the tactile bass vibrators 106 may be between about 16 Hz and about 512 Hz or between about 16 Hz and about 200 Hz (e.g., between about 40 Hz and about 60 Hz). Thus, the audio speakers 104 may be sized and configured primarily for emitting audible frequencies in the high and midlevel audible frequencies, while the tactile bass vibrators 106 may be sized and configured primarily for emitting audible frequencies in the bass and low bass frequencies.

The left-side and right-side audio speakers 104 and left-side and right-side tactile bass vibrators 106 may be configured as, for example, over-the-ear, on-ear, in-concha, or in-ear earphones. The left-side and right-side audio speakers 104 and left-side and right-side tactile bass vibrators 106 may be located within housings 108 of the headphone device 102. In embodiments where the headphone device 102 exhibits an over-the-ear or an on-ear configuration, the housings 108 may define left-side and right-side ear cups 110 of the headphone device 102. In such embodiments, the headphone device 102 may include a headband 112 supporting the ear cups 110, sized and shaped to rest on a user's head, and positioning the ear cups 110 proximate (e.g., over or on) the user's ears, when using the headphone device 102.

The headphone device 102 may be operatively connectable to a media player 114 to receive audio signals from the media player 114. For example, a wiring assembly 116 electrically connected to the audio speakers 104 and tactile bass vibrators 106 of the headphone device 102 may extend from one or both of the ear cups 110 and include an audio connector 118 (e.g., a male audio jack) for connecting the headphone device 102 to the media player 114. As another example, the headphone device 102 may be wirelessly connectable to the media player 114, such as, for example, using BLUETOOTH® technology. In such an example, the headphone device 102 may include a power source (e.g., a battery), which may be located within the housing 108 of one or both of the ear cups 110, to provide electrical power to the wireless connection, the audio speakers 104, and the tactile bass vibrators 106.

The media player 114 may be, for example, any device configured for connecting to the headphone device 102 and sending audio signal signals to the headphone device 102. For example, the media player 114 may include a mating audio connector 120 (e.g., a female audio jack, a wireless connector, such as, for example, BLUETOOTH®, etc.), a control circuit 122 (e.g., a processor), a memory device 124 (e.g., flash memory), and user input devices 126 (e.g., a touchscreen, buttons, switches, etc.). As specific, nonlimiting examples, the media player 114 may be a portable digital music player, a tablet device, a mobile phone, a smartphone, a video game console (e.g., a portable video game console), an in-car infotainment system, a laptop or desktop computer, or a stereo system.

In embodiments where the headphone device 102 is operatively connected to the media player 114 by a wiring system 116 extending from the headphone device 102 to the media player 114, the media player 114 may be the sole source of electrical power for the headphone device 102. For example, the headphone device 102 may lack any battery or amplifier to provide additional electrical power to the audio speakers 104, the tactile bass vibrators 106, or both. More specifically, the headphone device 102 may be, for example, free of dedicated batteries and amplifiers for boosting the electrical power level of audio signals sent to the tactile bass vibrators 106.

In embodiments where the headphone device 102 is wirelessly connected to the media player 114, there may be only a single power source, or a single power source per ear cup 110, to provide electrical power to the headphone device 102. For example, the headphone device 102 may lack any dedicated amplifier to provide additional electrical power to the audio speakers 104, the tactile bass vibrators 106, or both. More specifically, the headphone device 102 may be, for example, free of dedicated amplifiers for providing additional electrical power to the tactile bass vibrators 106.

The headphone device 102 may include one or more current dividers 128 operatively connected to the audio speakers 104 and the tactile bass vibrators 106. For example, a current divider 128 may be located within the housing 108 of each ear cup 110 and operatively connected to the audio speaker 104 and tactile bass vibrator 106 of the respective ear cup 110. The current dividers 128 may be configured to provide greater electrical resistance to flow of current to the audio speakers 104 than to flow of current to the tactile bass vibrators 106. By ensuring a greater proportion of the available current flows to the tactile bass vibrators 106, the current dividers 128 may enable the tactile bass vibrators 106 to produce tactile vibrations without the provision of additional electrical power (e.g., utilizing a dedicated battery or amplifier).

Figure 2:
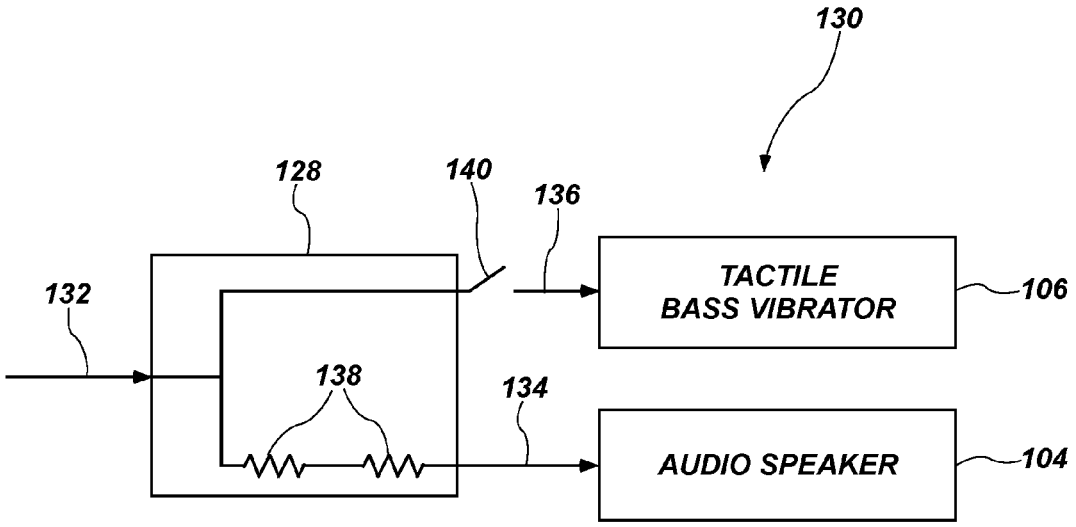
FIG. 2 is a simplified block diagram of a speaker assembly of the headphone device of FIG. 1.

FIG. 2 is a simplified block diagram of a speaker assembly 130 of the headphone device 102 of FIG. 1. The speaker assembly 130 may be located within the housing 108 of each ear cup 110 of the headphone device 102 of FIG. 2 to convert audio signals 132 received at the speaker assembly 130 to audible sound and a tactile vibration. The speaker assembly 130 may include an audio speaker 104 (e.g., an audio driver) configured to emit sound at audible frequencies, and an additional, distinct tactile bass vibrator 106 configured to emit audible sound at bass frequencies (e.g., low bass frequencies) and to generate tactile vibrations within the ear cups 110 (FIG. 1) that may be felt by the user.

The speaker assembly 130 may include a current divider 128 configured to receive input audio signals 132 and transmit a first split audio signal 134 to the audio speaker 104 and a second split audio signal 136 to the tactile bass vibrator 106. The current divider 128 may provide, for example, electrical resistance such that an electrical power of the first split audio signal 134 may be less than an electrical power of the second split audio signal 136. More specifically, the current divider 128 may provide electrical resistance in the electrical flow path from the input audio signal 132 to the first split audio signal 134 and may not provide any electrical resistance in the electrical flow path from the input audio signal 132 to the second split audio signal 136. As specific, nonlimiting examples, the current divider 128 may position one or more resistors 138 in the electrical flow path from the input audio signal 132 to the first split audio signal 134 and may not position any resistors in the electrical flow path from the input audio signal 132 to the second split audio signal 136, such that an electrical resistance of the current divider 128 in an electrical flow path directly connected to the audio speaker 104 is about 120Ω or greater or about 240Ω or greater (e.g., by positioning one, 120Ω resistor or two, 120Ω resistors in series in the electrical flow path from the input audio signal 132 to the first split audio signal 134).

In some embodiments, the speaker assembly 130 may lack any filtering elements to alter the range of frequencies in the first and second split audio signals 134 and 136 with respect to the input audio signal 132. For example, the range of frequencies in the first split audio signal 134 may be at least substantially equal to the range of frequencies in the second split audio signal 136. More specifically, the first split audio signal 134 and the second split audio signal 136 may both include, for example, high, midlevel, bass, and low bass frequencies. A primary difference between the first split audio signal 134 and the second split audio signal 136 may be an electrical power of the first split audio signal 134 and the second split audio signal 136. For example, a quantity of current in the first split audio signal 134 may be less than a quantity of current in the second split audio signal 136. Differences in detectable frequencies emitted from the audio speaker 104 and the tactile bass vibrator 106 may result from differences in the acoustic characteristics of the audio speaker 104 and the tactile bass vibrator 106, rather than differences between the first split audio signal 134 and the second split audio signal 136. For example, the audio speaker 104 may generate a greater quantity of detectable, audible sound in high and midlevel frequencies, and the tactile bass vibrator 106 may generate a greater quantity of detectable, audible sound in bass and low bass frequencies, despite the audio speaker 104 and the tactile bass vibrator 106 receiving first and second split audio signals 134 and 136, respectively, exhibiting at least substantially similar frequency ranges.

In other embodiments, the speaker assembly 130 may include one or more filtering elements (e.g., low-pass, high-pass, etc.) such that the first split audio signal 134 includes medium to high frequencies (i.e., non-bass frequencies), while the second split audio signal 136 includes bass frequencies. In some such embodiments, at least some of the frequencies of the first split audio signal 134 and the second split audio signal 136 may at least partially overlap. For example, the audio speaker 104 may be configured to emit some bass frequencies that are further enhanced by the tactile bass vibrator 106. The filtering elements may be passive filters, such that they do not require additional power from a dedicated power source (e.g., a dedicated battery or amplifier). For example, the sole power source for the filtering elements may be the media player 114 (see FIG. 1) connected to the headphone device 102 (see FIG. 1).

The speaker assembly 130 may include a switch 140 in the electrical flow path from the input audio signal 132 to the second split audio signal 136. The switch 140 may enable a user to start and stop receiving tactile vibrations from the tactile bass vibrator 106 by closing and opening the switch 140. The switch 140 may be directly electrically connected to the tactile bass vibrator 106, such that the switch 140 is positioned between the current divider 128 and the tactile bass vibrator 106 along the electrical path taken by the second split audio signal 136.

Figure 3:
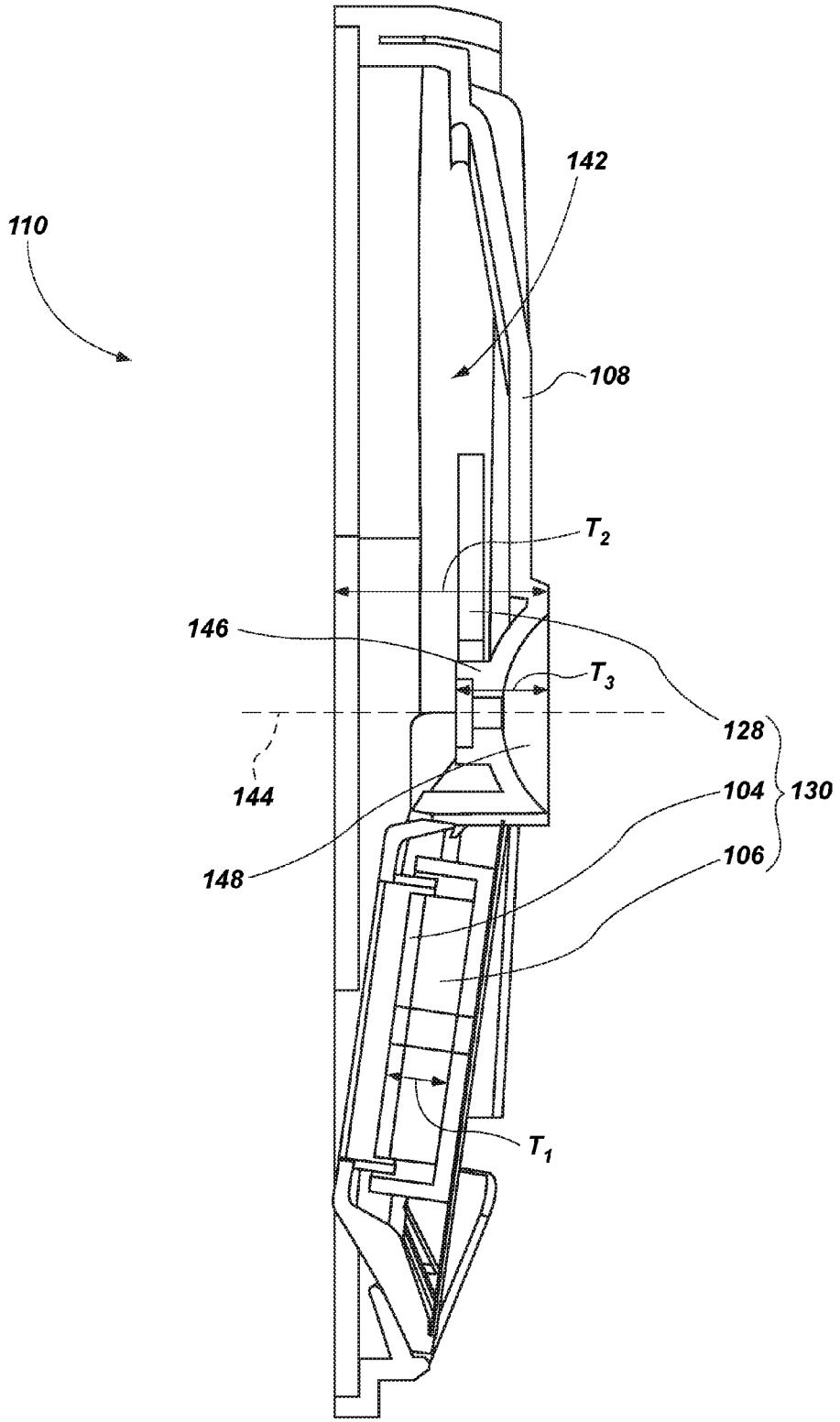
FIG. 3 is a cross-sectional view of a portion of the headphone device of FIG. 1.

FIG. 3 is a cross-sectional view of a portion of the headphone device 102 of FIG. 1. Specifically, FIG. 3 depicts a portion of an ear cup 110 of the headphone device 102 of FIG. 1. The housing 108 of the ear cup 110 may define an internal cavity 142 within which at least a portion of the speaker assembly 130 may be located. For example, at least the audio speaker 104, the tactile bass vibrator 106, and the current divider 128 of the speaker assembly 130 may be located within the internal cavity 142 defined by the housing 108.

The tactile bass vibrator 106 and the audio speaker 104 may be sufficiently small to enable the ear cup 110 to exhibit a low profile while still enabling generation of tactile vibrations. The audio speaker 104 and the tactile bass vibrator 106 may be located adjacent to one another within the ear cup 110. For example, a central axis of the audio speaker 104 and a central axis of the tactile bass vibrator 106 may be collinear, and a surface of the audio speaker 104 may contact a surface of the tactile bass vibrator 106. A maximum combined thickness $T_1$ of the tactile bass vibrator 106 and the audio speaker 104 in a direction parallel to a central axis of the tactile bass vibrator 106 may be, for example, about 5.0 mm or less. More specifically, the combined thickness $T_1$ of the tactile bass vibrator 106 and the audio speaker 104 may be, for example, about 4.5 mm or less. As a specific, nonlimiting example, a combined thickness $T_1$ of the tactile bass vibrator 106 and the audio speaker 104 may be about 4.0 mm or less. A maximum thickness $T_2$ of a rigid portion of the housing 108 (e.g., excluding any ear cushions connected to the housing 108) as measured in a direction parallel to a geometrical central axis 144 of the housing 108 may be, for example, about 20 mm or less. More specifically, the thickness $T_2$ of the rigid portion of the housing 108 may be, for example, about 18 mm or less. As a specific, nonlimiting example, the thickness $T_2$ of the rigid portion of the housing 108 may be about 17 mm or less.

The housing 108 may define a headband attachment structure 146 at an exterior of the ear cup 110 to enable the ear cup 110 to be attached to a headband 112 (see FIG. 1). In some embodiments, the headband attachment structure 146 may include an arcuate surface defining a pivoting portion 148 of the headband attachment structure 146, which may enable the ear cup 110 to pivot for adjustment relative to the headband 112 (see FIG. 1). The pivoting portion 148 of the headband attachment structure 146 may, for example, intersect with the geometrical central axis 144 of the housing 108, which may reduce differences in clamping pressure between an upper half and a lower half of the housing 108 when the ear cup 110 is attached to a headband 112 (see FIG. 1) utilizing the headband attachment structure 146. More specifically, a central axis of the headband attachment structure 146 may, for example, at least substantially align with the geometrical central axis 144 of the housing 108.

The audio speaker 104 and the tactile bass vibrator 106 may be offset from the geometrical central axis 144 of the housing 108. For example, the geometrical central axis 144 of the housing 108 may not intersect with the audio speaker 104 and the tactile bass vibrator 106. As a result, a thickness $T_3$ of the headband attachment structure 146 as measured in a direction parallel to the geometrical central axis 144 of the housing 108 may, for example, overlap longitudinally with the combined thickness $T_1$ of the audio speaker 104 and the tactile bass vibrator 106. More specifically, a line passing through the thickness $T_3$ of the headband attachment structure 146 in a direction at least substantially perpendicular to the geometrical central axis 144 of the housing 108 may, for example, intersect with the combined thickness $T_1$ of the audio speaker 104 and the tactile bass vibrator 106. By longitudinally offsetting the audio speaker 104 and the tactile bass vibrator 106 from the headband attachment structure 146, the thickness $T_2$ of the housing 108 may be reduced.

Figure 4:
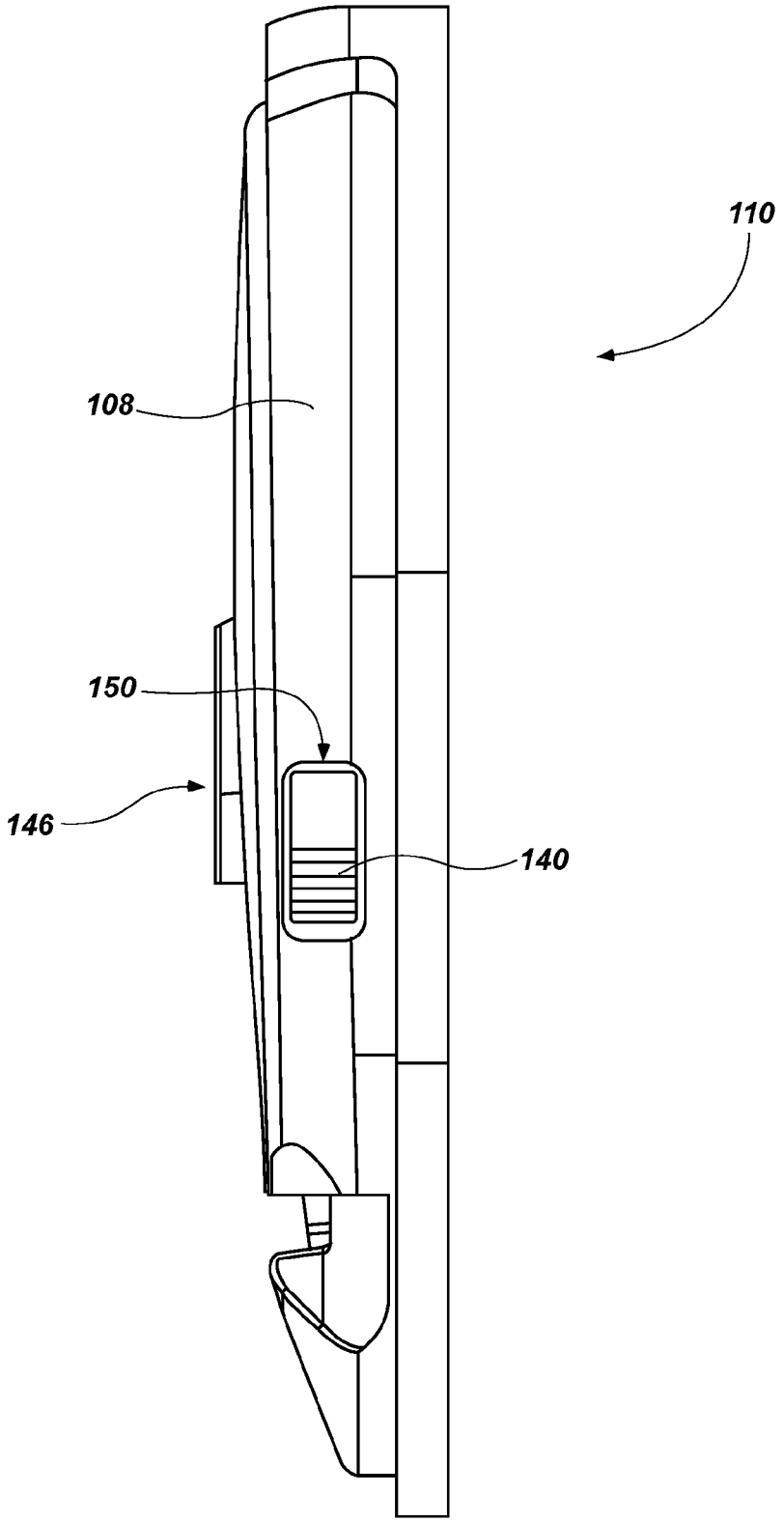
FIG. 4 is a side view of an ear cup of the headphone device of FIG. 1.

FIG. 4 is a side view of an ear cup 110 of the headphone device 102 of FIG. 1. The switch 140 of the speaker assembly 130 (see FIG. 3) may be accessible at the exterior of the housing 108. For example, the housing 108 may define an access port 150 at the exterior of the housing 108 through which the switch 140 may be accessible for manual operation by a user. More specifically, the switch 140 may at least partially extend through the access port 150 such that a user is not required to access an interior of the housing 108 to manipulate the switch 140.

Figure 5:
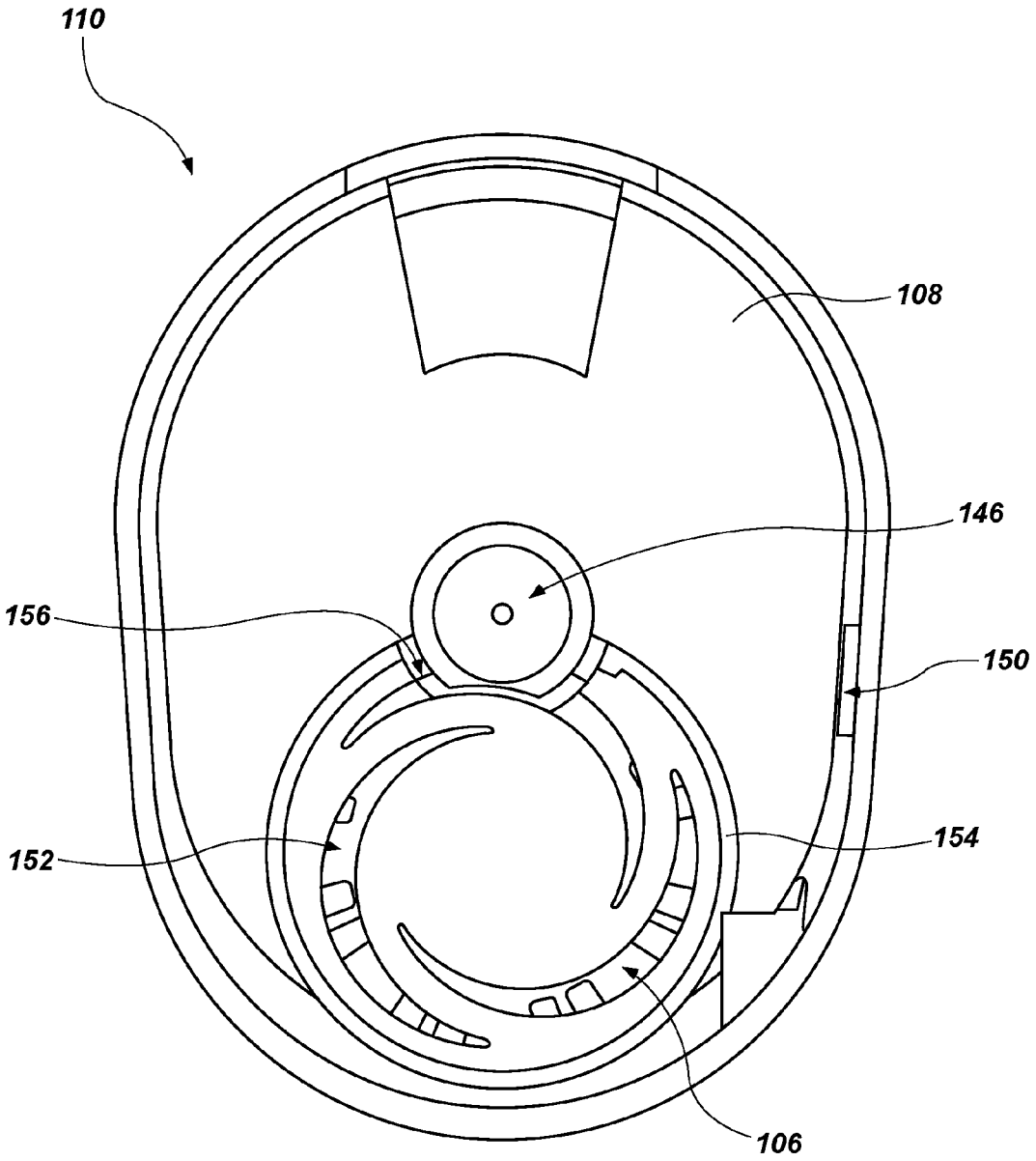
FIG. 5 is a rear view of the ear cup of FIG. 4.

FIG. 5 is a rear view of the ear cup 110 of FIG. 4. The ear cup 110 may define viewing ports 152 in the housing 108 to enable a user to see at least a portion of the internal components of the ear cup 110. For example, at least a portion of a vibration member 154 (e.g., a diaphragm or spring) or the tactile bass vibrator 106 may be viewable through the viewing ports 152. The vibration member 154 may be configured to vibrate such that its vibrations are felt in a tactile manner by a user in contact with the ear cup 110. When it is said that the resonant frequency of the tactile bass vibrator 106 may be between about 16 Hz and about 512 Hz or between about 16 Hz and about 200 Hz (e.g., between about 40 Hz and about 60 Hz), what is meant is that a resonant frequency of the vibration member 154 of the tactile bass vibrator 106 may be between about 16 Hz and about 512 Hz or between about 16 Hz and about 200 Hz (e.g., between about 40 Hz and about 60 Hz).

A circumference of the vibration member 154 may intersect with a circumference of the headband attachment structure 146 of the housing 108. For example, a portion of the headband attachment structure 146 may extend into a cutaway void 156 defined by the vibration member 154, which may accommodate the headband attachment structure 146 within what would otherwise have been the periphery of the vibration member 154. More specifically, the cutaway void 156 defined by the vibration member 154 may render an otherwise circular periphery of the vibration member 154 noncircular.

Additional, illustrative embodiments within the scope of this disclosure include the following:

Embodiment 1: A speaker assembly for a headphone device, comprising: an audio speaker configured to produce audible sound in response to receiving an audio signal at the audio speaker; a tactile bass vibrator distinct from the audio speaker, the tactile bass vibrator being configured to produce tactile vibrations in response to receiving the audio signal at the tactile bass vibrator, the tactile bass vibrator being operatively connected to the audio speaker, and a current divider operatively connected to the audio speaker and the tactile bass vibrator, the current divider providing greater electrical resistance to flow of current to the audio speaker than to flow of current to the tactile bass vibrator.

Embodiment 2: The speaker assembly of Embodiment 1, wherein the current divider comprises a resistor in an electrical flow path directly connected to the audio speaker.

Embodiment 3: The speaker assembly of Embodiment 1 or Embodiment 2, wherein a resistance of the current divider in an electrical flow path directly connected to the audio speaker is about 120Ω or greater.

Embodiment 4: The speaker assembly of Embodiment 3, wherein the resistance of the current divider in the electrical flow path directly connected to the audio speaker is about 240Ω or greater.

Embodiment 5: The speaker assembly of any one of Embodiments 1 through 4, wherein the speaker assembly lacks a dedicated amplifier to power the tactile bass vibrator.

Embodiment 6: The speaker assembly of any one of Embodiments 1 through 5, further comprising a switch in an electrical flow path directly connected to the tactile bass vibrator.

Embodiment 7: The speaker assembly of any one of Embodiments 1 through 6, wherein a resonant frequency of the tactile bass vibrator is between about 40 Hz and about 60 Hz.

Embodiment 8: The speaker assembly of any one of Embodiments 1 through 7, further comprising a housing defining an internal cavity within the housing, wherein each of the audio speaker, the tactile bass vibrator, and the current divider are located in the internal cavity.

Embodiment 9: The speaker assembly of Embodiment 8, further comprising a headband attachment structure defined by the housing, wherein a pivoting portion of the headband attachment structure intersects with a geometrical central axis of the housing.

Embodiment 10: The speaker assembly of any one of Embodiments 1 through 9, wherein a combined thickness of the audio speaker and the tactile bass vibrator is about 4 mm or less.

Embodiment 11: A headphone device, comprising: a headband sized and shaped to rest on a user's head; and an ear cup at each of two ends of the headband, the ear cups being located proximate a user's ears when the user wears the headband, each ear cup supporting a speaker assembly within an internal cavity defined by a housing of each ear cup, each speaker assembly comprising: an audio speaker configured to produce audible sound in response to receiving an audio signal at the audio speaker; a tactile bass vibrator distinct from the audio speaker, the tactile bass vibrator being configured to produce tactile vibrations in response to receiving the audio signal at the tactile bass vibrator, the tactile bass vibrator being operatively connected to the audio speaker; and a current divider operatively connected to the audio speaker and the tactile bass vibrator, the current divider providing greater electrical resistance to flow of current to the audio speaker than to flow of current to the tactile bass vibrator.

Embodiment 12: The headphone device of Embodiment 11, wherein the current divider comprises a resistor in an electrical flow path directly connected to the audio speaker.

Embodiment 13: The headphone device of Embodiment 11 or Embodiment 12, wherein a resistance of the current divider in an electrical flow path directly connected to the audio speaker is about 120Ω or greater.

Embodiment 14: The headphone device of Embodiment 13, wherein the resistance of the current divider in the electrical flow path directly connected to the audio speaker is about 240Ω or greater.

Embodiment 15: The headphone device of any one of Embodiments 11 through 14, wherein the speaker assembly lacks a dedicated amplifier to power the tactile bass vibrator.

Embodiment 16: The headphone device of any one of Embodiments 11 through 15, further comprising a switch in an electrical flow path directly connected to the tactile bass vibrator.

Embodiment 17: The headphone device of any one of Embodiments 11 through 16, wherein a resonant frequency of the tactile bass vibrator is between about 40 Hz and about 60 Hz.

Embodiment 18: The headphone device of any one of Embodiments 11 through 17, wherein the housing of each ear cup comprises a headband attachment structure defined by the housing, wherein a pivoting portion of the headband attachment structure intersects with a geometrical central axis of the housing.

Embodiment 19: A headphone device, comprising: a headband sized and shaped to rest on a user's head; and an ear cup attached to the headband at each of two ends of the headband utilizing a headband attachment structure of the ear cup, the ear cups being located proximate a user's ears when the user wears the headband, each ear cup supporting a speaker assembly within an internal cavity defined by a housing of each ear cup, each speaker assembly comprising: an audio speaker configured to produce audible sound in response to receiving an audio signal at the audio speaker; and a tactile bass vibrator distinct from the audio speaker, the tactile bass vibrator comprising a vibration member configured to produce tactile vibrations in response to receiving the audio signal at the tactile bass vibrator, the tactile bass vibrator being operatively connected to the audio speaker; wherein a circumference of the vibration member of the tactile bass vibrator intersects with a circumference of the headband attachment structure of the ear cup, the headband attachment structure extending into a cutaway void defined by the vibration member.

Embodiment 20: The headphone device of Embodiment 19, wherein the cutaway void defined by the vibration member renders a periphery of the vibration member non-circular.

Embodiment 21: The headphone device of Embodiment 19 or Embodiment 20, further comprising a current divider operatively connected to the audio speaker and the tactile bass vibrator, the current divider providing greater electrical resistance to flow of current to the audio speaker than to flow of current to the tactile bass vibrator.

Embodiment 22: The headphone device of any one of Embodiments 19 through 21, wherein the speaker assembly lacks a dedicated amplifier to power the tactile bass vibrator.

Embodiment 23: The headphone device of any one of Embodiments 19 through 22, further comprising a switch in an electrical flow path directly connected to the tactile bass vibrator.

Embodiment 24: The headphone device of any one of Embodiments 19 through 21, wherein a resonant frequency of the vibration member of the tactile bass vibrator is between about 40 Hz and about 60 Hz.

Embodiment 25: The headphone device of any one of Embodiments 19 through 24, wherein a pivoting portion of the headband attachment structure intersects with a geometrical central axis of the housing.

Embodiment 26: A method of forming a speaker assembly for a headphone device, comprising: configuring an audio speaker to produce audible sound in response to receiving an audio signal at the audio speaker; operatively connecting a tactile bass vibrator distinct from the audio speaker to the audio speaker, the tactile bass vibrator being configured to produce tactile vibrations in response to receiving the audio signal at the tactile bass vibrator; and operatively connecting a current divider to the audio speaker and the tactile bass vibrator, the current divider providing greater electrical resistance to flow of current to the audio speaker than to flow of current to the tactile bass vibrator.

Embodiment 27: The method of Embodiment 26, wherein operatively connecting the current divider to the audio speaker and the tactile bass vibrator comprises positioning a resistor in an electrical flow path directly connected to the audio speaker.

Embodiment 28: The method of Embodiment 26 or Embodiment 27, further comprising refraining from operatively connecting a dedicated amplifier to power the tactile bass vibrator to the speaker assembly.

Embodiment 29: The method of any one of Embodiments 26 through 28, further comprising positioning a switch in an electrical flow path directly connected to the tactile bass vibrator.

Embodiment 30: The method of any one of Embodiments 26 through 29, further comprising positioning each of the audio speaker, the tactile bass vibrator, and the current divider within an internal cavity defined by a housing, wherein the housing comprises a headband attachment structure defined by the housing, wherein a pivoting portion of the headband attachment structure intersects with a geometrical central axis of the housing.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A headphone device, comprising:

a headband sized and shaped to rest on a user's head; and an ear cup at each of two ends of the headband, the ear cups being located proximate a user's ears when the user wears the headband, each ear cup supporting a speaker assembly within an internal cavity defined by a housing of each ear cup, each speaker assembly comprising:

an audio speaker configured to produce audible sound in response to receiving an audio signal at the audio speaker;

a tactile bass vibrator distinct from the audio speaker, the tactile bass vibrator being configured to produce tactile vibrations in response to receiving the audio signal at the tactile bass vibrator, the tactile bass vibrator being operatively connected to the audio speaker; and a current divider operatively connected to the audio speaker and the tactile bass vibrator, the current divider permanently providing greater electrical resistance to flow of current to the audio speaker than to flow of current to the tactile bass vibrator;

wherein each speaker assembly dedicated amplifier to power the tactile bass vibrator.

2. The headphone device of claim 1, wherein the current divider comprises a resistor in an electrical flow path directly connected to the audio speaker.

3. The headphone device of claim 1, wherein a resistance of the current divider in an electrical flow path directly connected to the audio speaker is about 120Ω or greater.

4. The headphone device of claim 3, wherein the resistance of the current divider in the electrical flow path directly connected to the audio speaker is about 240Ω or greater.

5. The headphone device of claim 1, further comprising a switch in an electrical flow path directly connected to the tactile bass vibrator.

6. The headphone device of claim 1, wherein a resonant frequency of the tactile bass vibrator is between about 40 Hz and about 60 Hz.

7. The headphone device of claim 1, wherein the housing of each ear cup comprises a headband attachment structure defined by the housing, wherein a pivoting portion of the headband attachment structure intersects with a geometrical central axis of the housing.

8. A headphone device, comprising:

a headband sized and shaped to rest on a user's head; and an ear cup attached to the headband at each of two ends of the headband utilizing a headband attachment structure of the ear cup, the ear cups being located proximate a user's ears when the user wears the headband, each ear cup supporting a speaker assembly within an internal cavity defined by a housing of each ear cup, each speaker assembly comprising:

an audio speaker configured to produce audible sound in response to receiving an audio signal at the audio speaker; and a tactile bass vibrator distinct from the audio speaker, the tactile bass vibrator comprising a vibration member configured to produce tactile vibrations in response to receiving the audio signal at the tactile bass vibrator, the tactile bass vibrator being operatively connected to the audio speaker;

wherein a circumference of the vibration member of the tactile bass vibrator intersects with a circumference of the headband attachment structure of the ear cup, the headband attachment structure extending into a cutaway void defined by the vibration member;

wherein each speaker assembly lacks a dedicated amplifier to power the tactile bass vibrator.

9. The headphone device of claim 8, wherein the cutaway void defined by the vibration member renders a periphery of the vibration member as viewed in a direction parallel to a direction of vibrational movement of the vibration member noncircular.

10. The headphone device of claim 8, further comprising a current divider operatively connected to the audio speaker and the tactile bass vibrator, the current divider permanently providing greater electrical resistance to flow of current to the audio speaker than to flow of current to the tactile bass vibrator.

11. The headphone device of claim 8, further comprising a switch in an electrical flow path directly connected to the tactile bass vibrator.

12. The headphone device of claim 8, wherein a resonant frequency of the vibration member of the tactile bass vibrator is between about 40 Hz and about 60 Hz.

13. The headphone device of claim 8, wherein a pivoting portion of the headband attachment structure intersects with a geometrical central axis of the housing.

14. A method of forming a speaker assembly for a headphone device, comprising:

configuring an audio speaker to produce audible sound in response to receiving an audio signal at the audio speaker;

operatively connecting a tactile bass vibrator distinct from the audio speaker to the audio speaker, the tactile bass vibrator being configured to produce tactile vibrations in response to receiving the audio signal at the tactile bass vibrator; and operatively connecting a current divider to the audio speaker and the tactile bass vibrator, the current divider permanently providing greater electrical resistance to flow of current to the audio speaker than to flow of current to the tactile bass vibrator; and refraining from operatively connecting a dedicated amplifier to the speaker assembly to power the tactile bass vibrator.

15. The method of claim 14, wherein operatively connecting the current divider to the audio speaker and the tactile bass vibrator comprises positioning a resistor in an electrical flow path directly connected to the audio speaker.

16. The method of claim 14, further comprising positioning a switch in an electrical flow path directly connected to the tactile bass vibrator.

17. The method of claim 14, further comprising positioning each of the audio speaker, the tactile bass vibrator, and the current divider within an internal cavity defined by a housing, wherein the housing comprises a headband attachment structure defined by the housing, wherein a pivoting portion of the headband attachment structure intersects with a geometrical central axis of the housing.

* * * * *